United States Patent [19]

Penzhorn et al.

[11] 4,454,062

[45] Jun. 12, 1984

[54] METHOD FOR IMMOBILIZING RADIOACTIVE NOBLE GASES IN ZEOLITES

[75] Inventors: Ralf-Dieter Penzhorn, Bruchsal; Peter Schuster, Wörth, both of Fed. Rep. of Germany

[73] Assignee: Kernforschungszentrum Karlsruhe Gesellschaft mit beschränkter Haftung, Karlsruhe, Fed. Rep. of Germany

[21] Appl. No.: 173,268

[22] Filed: Jul. 25, 1980

[30] Foreign Application Priority Data

Dec. 1, 1979 [DE] Fed. Rep. of Germany ..... 2948515

[51] Int. Cl.[3] ..... G21F 9/02

[52] U.S. Cl. ..... 252/630; 55/66

[58] Field of Search ..... 252/630; 55/66

[56] References Cited

U.S. PATENT DOCUMENTS

| | | | |
|---|---|---|---|
| 3,316,691 | 5/1967 | Sesny et al. | 55/66 |
| 3,971,640 | 7/1976 | Golovko | 55/66 |
| 4,158,639 | 6/1979 | Berty | 252/630 |

OTHER PUBLICATIONS

Barrer et al., "The Sorption of Krypton and Xenon in Zeolites at High Pressure and Temperatures, I. Chabazite", Proc. R. Soc. Land, vol. 326, pp. 315 to 330 (1972).

Barrer et al., "The Sorption of Krypton and Xenon in Zeolites at High Pressure and Temperatures, II. Comparison & Analysis", Proc. R. Soc. Land A., vol. 326, pp. 331 to 345 (1972).

Römpp, "Chemie-Lexikon", 7th Edition, (1977), p. 3971.

Brown et al., "$^{85}$Kr Storage by Zeolite Encapsulation," *Proc. 14th ERDA Air. Clean. Conf.*, 1976, CONF-760822, vol. 1, pp. 118-131 (Feb. 1977).

Benedict et al., "Technical and Economic Feasibility of Zeolite Encapsulation for Krypton-85 Storage," ENICO-1011 (Sep. 1979).

*Primary Examiner*—Brooks H. Hunt

*Attorney, Agent, or Firm*—Sughrue, Mion, Zinn, Macpeak & Seas

[57] ABSTRACT

In a method for immobilizing a radioactive noble gas in a zeolite matrix by pressing the noble gas, after heat treatment of the zeolite matrix, into the cavities of the structure of the zeolite matrix under high pressure, and cooling the matrix while maintaining the pressure in order to encapsulate the gas in the cavities, use is made of a zeolite matrix composed of an alkaline earth metal exchanged zeolite having a 0.5 nm pore diameter and of the general composition $$M_6[AlO_2)_{12}(SiO_2)_{12}].\ H_2O,$$

where M is Mg, Ca, Ba or Sr.

9 Claims, No Drawings

METHOD FOR IMMOBILIZING RADIOACTIVE NOBLE GASES IN ZEOLITES

BACKGROUND OF THE INVENTION

The present invention relates to a method for immobilizing radioactive noble gases in a zeolite matrix wherein the noble gas, after heat treatment of the zeolite matrix, is forced under high pressure into the cavities of the structure of the zeolite matrix and is encapsulated in these cavities by cooling the matrix while maintaining the pressure.

The waste gases developed during reprocessing of irradiated nuclear reactor fuel elements contain certain quantities of radioactive noble gases, originating particularly from removal of the cladding of the fuel elements and subsequent dissolution of the fuel material. In the prior art, these noble gases, if they were separated from the waste gases at all, were introduced into pressurized steel bottles for transport to a location which permitted limited time storage.

The radioactive gas in such a pressurized bottle is under a high pressure, e.g. more than 100 bar, where 1 bar=0987 std. atm., spontaneously generates heat, and, depending on the radioactivity inventory in the bottle or the cooling mode, e.g., natural air convection, attains an increased temperature, e.g. 393° K. Thus the wall of such a bottle is continuously subjected to substantial thermally induced tensile stress. If the cooling system were to malfunction or become inoperative, it is possible that the bottle would crack or burst, resulting in the release of the entire radioactive noble gas inventory being stored or transported.

The noble fission gas consists mainly of krypton and xenon isotopes. The daughter nuclide of krypton is rubidium, an alkali metal which is highly reactive and capable of inflicting corrosion damage. Rubidium and certain impurities possibly present in the noble gas, such as, e.g. oxygen, water, etc., react together and form products such as, for example, $Rb_2O$, RbOH, etc., which are even more corrosive than the alkali metal itself (the latter will be in a molten state at the storage temperatures, excepted during the first decades.

The grave drawbacks of storing radioactive noble gases in pressurized gas bottles on one hand and the large quantities of krypton-85 expected to have to be stored safely for long periods of time in the future, on the other, have made it necessary to search for alternative ways to carry out the long-term storage of highly radioactive noble gases. One alternative that has been proposed previously consists in the solidification of noble gases in zeolites or molecular sieves.

Zeolites or molecular sieves, have been used, for example, in the separation of mixtures of substances by means of gas chromatography, involving a large number of repeated alternations of adsorption and desorption processes. However, in the solidification of radioactive noble gases in zeolites, desorption must be avoided as much as possible because increased safety during transport and storage can be assured only if gas diffusion out of the loaded zeolite is only very slight. Essentially, the gas diffusion is determined by the type of zeolite, and by the temperature.

The temperature in the zeolite structure itself depends on the radioactive gas load in the zeolite and the heat transfer through the inorganic matrix/gaseous phase. A large number of tests have been made directed toward the selection of suitable zeolites and the best process conditions. Normally, molecules having a larger diameter than the channels or pores in a given zeolite are not sorbed by that zeolite. However, it has been found that by inceasing the temperature from room temperature to, for example, 770° K., the pores of certain zeolites, as, for example, zeolite 3A or sodalite, are widened and krypton can be forced into these cavities in the crystal structure under a very high pressure, e.g. 2000 bar. If thereafter the system is cooled while maintaining the high pressure, the gas is encapsulated in the cavities. The encapsulated gas is then, in contradistinction to the condition existing in the case of adsorption, not in equilibrium with the gaseous phase.

A series of differently produced, leached and unleached sodalite types have been examined as to their capability to encapsulate krypton or krypton-xenon mixtures, they have been described in the report by R. W. Benedict, A. B. Christensen, J. A. Del Debbio, J. H. Keller, and D. A. Knecht: Technical and Economic Feasibility of Zeolite Encapsulation for Krypton-85 Storage; DOE Report No. ENICO-1011, September, 1979. In their encapsulation experiments, the authors employed temperatures between 670° and 850° K., and pressures between 1200 and 2000 bar.

In order to evaluate which zeolites were best suited for the encapsulation of krypton, untreated K-exchanged, Cs-exchanged, and Rb-exchanged zeolites A and various sodalite types were examined with respect to maximum loading as well as temperature and radiation resistance to gas diffusion out of the loaded zeolites (krypton leakages). Krypton loadings from 20 to 40 $cm^3$ STP/g sodalite or zeolite A were found. The loading values for leached sodalite were higher than for unleached sodalite. Krypton leakage measurements were made over short times, i.e. about 2 to 24 hours, at temperatures between 570° and 775° K. and for longer periods, i.e. about 1 to 12 months, at a temperature of 423° K. The lowest leakage rates were found:

(a) for samples with low adsorbed $H_2O$ content compared to samples with high adsorbed $H_2O$ content;
(b) for samples with high initial krypton loading compared to samples with low loading;
(c) for unleached sodalite compared to leached sodalite.

From the test results, Benedict et al drew the conclusion that for unleached sodalite with a krypton loading of about 20 $cm^3$/g and low quantities of adsorbed water, the predicted 10-year leakage of krypton at a final storage temperature of 423° K. will be less than 0.1%.

Under consideration of the Kr-85 decay heat, sodalite (of the formula $Na_2O \times Al_2O_3 \times 2SiO_2 \times 2.5\ H_2O$) seemed to be sufficiently thermally stable after loading with noble gas to assure the immobilization of krypton-85 for more than 100 years without the use of a technically very complicated closing of pores, which could possibly be effected in the rolling or fluidized bed process with a still to be found radiation resistant resin. The long term thermal stability at temperatures above 423° K. which initially had been determined theoretically by extrapolation on the basis of the activation energy for the gas diffusion out of the zeolite could, however, not be confirmed experimentally.

Tests with sodalite samples loaded with argon, (the effective kinetic diameters of Kr and Ar are very similar, i.e. 0.39 mm for krypton and 0.37 mm for argon), have shown that already at 473° K. the stability towards elevated temperatures of the loaded sodalite samples is insufficient. Sodalite loaded with 30.5 $cm^3$ STP Ar/g, looses 52% of the encapsulated gas at 473° K. already after 1080 hours. This desorption, which is undesirable for final storage, can be counteracted only by restriction of loading or use of a pore closing resin. Lower loading, however, is associated with increased costs and increased waste volume. Furthermore, the homogeneous embedding of highly radioactive extrudates in a resin is a technically difficult undertaking.

Additionally, the recommended loading conditions, for example, a temperature of 773° K. and a pressure of 2000 bars, are undesirable when working with large inventories of radioactive gases. Since the use of at least one compressor is required, the expenditures required to keep down leakages at the apparatus are considerable. A high pressure system which is complicated from a safety point of view becomes a prerequisite.

SUMMARY OF THE INVENTION

It is therefore an object of the present invention to enable large future inventories of radioactive noble gases to be immobilized in a solid form in such a manner that they will not be released from the final storage matrix in which they are stored even at temperatures of 473° K. and more.

A further object of the present invention is to fix as large an amount of noble gas per unit weight of final storage matrix as possible.

Yet another, concommitant, object of the invention is to eliminate all drawbacks of the prior art methods for solid form immobilization of noble gases.

These and other objects are achieved in a surprisingly simple manner, according to the present invention, by using an alkaline earth metal exchanged zeolite which is identified as 5 A, signifying that it presents a pore diameter of the order of 0.5 nm and which has the general composition:

$$M_6[(AlO_2)_{12}(SiO_2)_{12}].H_2O,$$

where M is Mg, Ca, Ba or Sr.

Using a zeolite selected according to the invention, the method according to the invention can be performed by:

(a) bringing the noble gas to be immobilized into contact with the zeolite in a vessel which was previously evacuated to a pressure of less than 1 mbar;
(b) then forcing, or pressing, the noble gas into the cavities of the zeolite at a temperature in the range from 720° K. to 870° K. and under a pressure of 200 bar to about 2000 bar; and
(c) finally, cooling the zeolite loaded with the noble gas in a known manner.

Evacuation is carried out after the zeolite has been introduced into the high pressure vessel and the latter has been hermetically closed. The object of the evacuation is to remove air from the vessel and residual adsorbed water from the zeolite. After the evacuation the vessel is isolated from the vacuum pump and ready for the gas fixation.

According to a particularly advantageous embodiment of the method according to the invention, evacuation of the vessel takes place at elevated temperatures in the range from 420° K. to 530° K.

The aluminiumsilicate framework of zeolite A can be described in terms of two types of polyhedra; one is a simple cubic arrangement of eight tetrahedra and the other is the truncated octahedron of 24 tetrahedron ($\beta$-cage). When each corner of the cube is occupied by a truncated octahedron an additional cavity is formed ($\alpha$-cage).

The loading tests performed thus far, at pressures up to 2000 bar, resulted in argon loadings of up to 57 $cm^3$ STP/g zeolite, measured with respect to the loaded zeolite mass. Examination of the thermal stability of earth alkali zeolites of the type 5 A loaded with krypton kshowed within the experimental accuracy that after 2520 hours at 473° K. or 3500 hours at 673° K., respectively, no gas was released. This conclusion was reached by comparing the loading of the zeolites before and after the heat treatment. The accuracy of these measurements was ±5%.

Additional experiments with a relatively high heating rate, i.e. about 50° C./minute at the start, dropping to about 20° C./min after 870° K., showed that the diffusion of krypton out of the zeolite began only at about 1080° K. However, only about 1 to 3% of the total load was released between 1080° and 1180° K., after about 16 to 20 minutes. The major portion of the encapsulated gas escaped from the crystal structure only when the temperatures reached between 1180° K. and 1380° K., after 20 to 29 minutes.

For comparison a sample of sodalite loaded with krypton was subjected to the same temperature treatment. Already after 7 minutes, e.g. at a temperature of 675° K., degasification began. The major portion of the noble gas was released under these conditions between 775° K. and 1180° K. The sodalite sample employed in this investigation was synthesized by a commercial manufacturer.

The substituted zeolites which can be used in the process of the present invention are resistant to gamma radiation. Samples containing immobilized argon and subjected to a gamma radiation dose of $10^6$ J/kg exhibited no noticeable changes. Likewise, loaded samples which had been stored in water for several days exhibited stable behavior with respect to gas immobilization.

Furthermore, tests were made to determine the distribution of the solidified noble gas in the alpha and beta cavities of a zeolite according to the invention. The loading was effected in a temperature range of about 710° K. to 810° K., the maximum loading at 770° K. being about 50 $cm^3$ STP/g. It has been found that the loading of the alpha cavities begins at 710° K., rises steeply soon after to begin to drop slowly again already at about 730° K. down to a temperature of about 780° K. at which the loading of the alpha cavities is practically zero. Although the loading of the beta cavities at this temperture lies somewhat below the maximum at about 43 $cm^3$ STP/g with respect to the loaded zeolite, this temperature must be considered the optimum loading temperature under these test conditions. Due to the exclusive loading of the beta cavities in zeolites the prerequisites are met for:

(a) a reduction of gas diffusion from the loaded zeolite matrix so that even with high loads no pore closing methods (resin, glass etc.) need be employed and simultaneously safety is increased not only during the transport of the solidified radioactive gas but also during long-term storage;
(b) sorption of in the noble gas at relatively low pressure, e.g., less than 600 bar;
(c) fixing without compressors employing for instace a combination cryoautoclave/high pressure autoclave achieving consequently a reduction of potential leakage sources and a reduction of the free inventory of radioactive noble gas; and (d) recovery of the noble fission gas not fixed after pressing, remaining in the lines of the apparatus and the autoclav, by cryopump effect.

Instead of the previously required mechanical compression, the gas in the autoclave can be brought either from a preliminary pressure to a pressure 2.7 times higher by simply increasing the temperature or, with the use of the cryopump principle, to even higher pressures. A further advantage of the process according to the invention is a reduction in material stresses accomplished by reduced pressures in the process according to the invention compared to the prior art process.

The present invention will now be explained with the aid of a few examples and experiments. However, the invention is not limited to the stated examples. The alkaline earth metal zeolites mentioned in the examples are commercially available products of various manufacturers or distributors whose product names permit no conclusion as to their chemical composition. For that reason the zeolites that can be used in the process of the present invention have simply been identified as Z1 to Z6 (distributors in the FRG are given in parenthesis)

| | |
|---|---|
| $Z_1$ = Typ 5 A (CECA GmbH) | M = Sr 2 mm diameter spheres |
| $Z_2$ = Typ 5 A (Roth) | M = Ca 1–2 mm diameter spheres |
| $Z_3$ = Typ 5 A (CECA GmbH) | M = Ca 2 mm diameter spheres |
| $Z_4$ = Typ 5 A (CECA GmbH) | M = Ca 3 mm diameter spheres |
| $Z_5$ = Typ 5 A (CECA GmbH) | M = Ca powder |
| $Z_6$ = Typ 5 A (CECA GmbH) | M = Ca 3 mm excludate |

EXAMPLE 1

Zeolite Z 3 was loaded with krypton at a temperature of about 823° K. and under a pressure of 210 bar. The loading attainable under these conditions was 17.2 $cm^3$ STP/g with respect to the loaded zeolite. To determine the thermal stability, the loaded zeolite was stored for 3500 hours at a temperature of 673° K. The subsequently repeated determination of krypton loading indicated that essentially no gas had escaped under these conditions.

EXAMPLE 2

After a pretreatment at 420° to 470° K. under vacuum, several samples of zeolite Z 5, initially placed under a vacuum, were loaded with argon at about 620 and bar and 823° K. The thermal stability of the loaded zeolite samples was examined after various periods of dwell at two different storage temperatures by again determining the loading. The samples which had been subjected to a storage temperature of 473° K. exhibited practically unchanged argon loading after a period of dwell of 1080 hours as well as after a period of dwell of 2520 hours. The existing difference in the results were within the range of experimental accuracy. Even the samples which had to withstand a storage temperature of 673° K. exhibited no argon losses after a period of dwell of 160 or 763 hours, respectively.

EXAMPLE 3

Samples of zeolite Z 6 which were loaded with argon at 260 bar and 773° K. exhibited no reduction in noble gas loading either after 1080 hours at 473° K. nor after 160 hours at 683° K.

In contradistinction thereto a zeolite identified as 3A which cannot be used in the process according to the invention and which was loaded to 42.6 $cm^3$ STP/g loaded zeolite, exhibited an argon loss of 57% of the original loading after a storage time of 1080 hours and a storage temperature of 473° K. A sample of this zeolite 3A with the same loading (42.6 $cm^3$ STP/g) was submitted to a storage temperature of 673° K. for 17.5 hours. The argon loss then determined by renewed determination of the loading was 88%. A similar behavior was exhibited by sodalite samples with a loading of 30.5 $cm^3$ STP/g loaded zeolite; after 1080 hours at a storage temperature of 473° K., 52% of the argon had escaped and after 15 hours, at a storage temperature of 673° K., even 96% of the original loading had escaped.

EXAMPLE 4

Zeolites from various origins were examined under the same conditions and their loading values were measured. After a pre-treatment at 425° K. to 475° K. in vacuum, krypton was pressed into the zeolite samples under a pressure of 1000 bar employing a fixation temperature of 770° to 795° K. The following loading values resulted:

| |
|---|
| Z 1 - 49.0 $cm^3$ STP/g loaded Zeolite |
| Z 2 - 44.3 $cm^3$ STP/g loaded Zeolite |
| Z 3 - 38.4 $cm^3$ STP/g loaded Zeolite |
| Z 4 - 37.4 $cm^3$ STP/g loaded Zeolite |
| Z 5 - 36.0 $cm^3$ STP/g loaded Zeolite |
| Z 6 - 29.0 $cm^3$ STP/g loaded Zeolite |

The loading values increase with increasing loading if they relate to the unloaded zeolite. While the value 20 $cm^3$ STP/g with respect to the loaded zeolite results in the value 21.6 $cm^3$ STP/g with respect to the unloaded zeolite, the loading value of 60 $cm^3$ STP/g loaded zeolite increases to 77.4 $cm^3$ STP/g unloaded zeolite. The last mentioned value was obtained at a pressure of about 2500 bar.

If one compares the operating conditions recommended by Benedict et al for their process, i.e. temperatures of 850° K. and above and pressures of 1660 bar and above to obtain a loading of 20 $cm^3$ STP krypton per gram of zeolite, with the operating conditions of the process according to the present invention required to obtain a loading of 20 $cm^3$ STP krypton per gram of unloaded zeolite, the significant advantages of the process according to the present invention become evident; the required loading pressure is only about 300 bar at a temperature of 793° K.

EXPERIMENT 1

Zeolite Z 3 loaded with 38.4 $cm^3$ STP krypton per gram of zeolite was subjected to a gamma radiation dose of $1.75 \times 10^8$ rad. The loaded zeolite was irradiated in neon, the duration of the radiation being about 2 months. Analysis of the gas phase after irradiation indicated that only a very small quantity of krypton (0.009%) had escaped from the zeolite matrix, presumably as a result of nonoptimum loading conditions, e.g. slight contribution of alpha cavities. The krypton loading determination of the zeolite after irradiation did not indicate any noticeable krypton loss, the value being within the range of experimental accuracy.

EXPERIMENT 2

Examination of the influence of water storage on the diffusion of gas out of the loaded zeolite;

A zeolite Z 4 loaded with 37.4 $cm^3$ STP krypton per gram zeolite was stored in water at room temperature for about 750 hours. After drying in an oven at 423° K. for 12 hours, the renewed determination of loading indicated 36.9 $cm^3$ STP Kr/g, i.e. the loading value remained within the experimental limits of accuracy, no krypton loss could be shown.

Comparison between the storage of krypton in pressure bottles and embedding of krypton in earth metal zeolites of type 5 A: if a 50 l pressure bottle is filled with 1 $m^3$ STP krypton, the pressure on the bottle wall is calculated at 22.6 bar. If the same amount of krypton is embedded in a 5 A zeolite, the volume of the loaded zeolite with a loading of 21.6 $cm^3$ STP/g has a volume of 66.1 l which is only slightly greater than the volume in the pressure bottle; with a loading of 47.1 $cm^3$ STP/g the volume is only slightly more than half of the pressure bottle volume, i.e. 30.4 l, and with a loading of 77.4 $cm^3$ STP/g about $\frac{1}{3}$ of the pressure bottle volume, i.e. only 18.5 l. Thus when loading 3 cubic meters STP of krypton, the volume of the loaded zeolite is approximately equal to the volume of a pressure bottle which, however, in this case is under a pressure of 71.4 bar. The 1.5 X volume of a zeolite loaded with 77.4 $cm^3$ STP/g compared to the volume of a pressure bottle corresponds to approximately 4 $m^3$ STP krypton at a pressure of 102 bar in the pressure bottle.

It will be understood that the above description of the present invention is susceptible to various modifications, changes and adaptations, and the same are intended to be comprehended within the meaning and range of equivalents of the appended claims.

What is claimed is:

1. In a method for immobilizing a radioactive noble gas in a zeolite matrix by pressing the noble gas, after heat treatment of the zeolite matrix, into the cavities of the structure of the zeolite matrix under high pressure, and cooling the matrix while maintaining the pressure in order to encapsulate the gas in the cavities, the improvement wherein the matrix is an alkaline earth metal exchanged zeolite of type 5A and of the general composition $$M_6[(AlO_2)_{12}(SiO_2)_{12}].H_2O,$$

where M is Mg, Ca, Ba or Sr, and said heat treatment and pressing are effected in such a manner that the gas, after being encapsulated in the matrix, is not released from the matrix even at a storage temperature of at least 473° K., by effecting said heat treatment at a temperature in the range of 420° to 530° K., and by effecting the pressing at a temperature in the range from 720° to 870° K. and at a pressure of 200 bar to about 1000 bar.

2. Method as defined in claim 1 comprising the preliminary step of bringing the noble gas to be immobilized into contact with the zeolite in a vessel which has been evacuated to a pressure of less than 1 mbar, and thereafter performing said step of pressing at a temperature in the range from 720° K. to 870° K. and under a pressure of 200 bar to about 2000 bar.

3. Method as defined in claim 2, wherein the evacuation of the vessel takes place at a temperature in the range of 420° K. to 530° K. to effect said heat treatment.

4. Method as defined in claim 1, wherein the pressing is performed at a pressure of 200 bar to 620 bar.

5. Method as defined in claim 1, wherein the pressing is performed at a pressure of 200 bar to 260 bar.

6. Method as defined in claim 1, wherein the pressing is performed at a pressure less than 600 bar.

7. Method as defined in claim 1, wherein the pressing is performed at a temperature of 770° K. to 870° K.

8. Method as defined in claim 1, wherein the pressing is performed at a temperature of 795° K. to 870° K.

9. Method as defined in claim 1, wherein the pressing is performed at a temperature of 823° to 870° K.

* * * * *